US006803135B2

(12) United States Patent
Liu et al.

(10) Patent No.: US 6,803,135 B2
(45) Date of Patent: Oct. 12, 2004

(54) THERMAL BARRIER COATING HAVING LOW THERMAL CONDUCTIVITY

(75) Inventors: Yourong Liu, Elmwood Park, NJ (US); Paul Lawton, Rock Hill, NY (US)

(73) Assignee: Chromalloy Gas Turbine Corporation, Orangeburg, NY (US)

( * ) Notice: Subject to any disclaimer, the term of this patent is extended or adjusted under 35 U.S.C. 154(b) by 93 days.

(21) Appl. No.: 10/372,570

(22) Filed: Feb. 24, 2003

(65) Prior Publication Data

US 2004/0166356 A1 Aug. 26, 2004

(51) Int. Cl.[7] ..... B32B 15/04; F03B 3/12; C03C 16/00

(52) U.S. Cl. ..... 428/701; 428/469; 428/336; 428/697; 428/699; 428/702; 428/632; 428/679; 416/241 B; 427/596; 427/255.319

(58) Field of Search ..... 428/469, 699, 428/697, 701, 702, 621, 632, 633, 650, 655, 679, 680, 336; 416/241 B; 427/596, 255.319; 501/102, 103, 126, 152

(56) References Cited

U.S. PATENT DOCUMENTS

| | | | | |
|---|---|---|---|---|
| 5,658,837 | A | * | 8/1997 | Quadir |
| 5,687,679 | A | | 11/1997 | Mullin et al. |
| 5,762,894 | A | * | 6/1998 | Takatori et al. |
| 5,792,521 | A | | 8/1998 | Wortman |
| 5,846,605 | A | | 12/1998 | Rickerby et al. |
| 5,908,800 | A | * | 6/1999 | Bonneau et al. |
| 5,985,404 | A | * | 11/1999 | Yano et al. |
| 6,071,628 | A | | 6/2000 | Seals et al. |
| 6,106,959 | A | | 8/2000 | Vance et al. |
| 6,117,560 | A | | 9/2000 | Maloney |
| 6,127,048 | A | | 10/2000 | Beele |
| 6,168,745 | B1 | * | 1/2001 | Jue et al. |
| 6,177,200 | B1 | | 1/2001 | Maloney |
| 6,183,884 | B1 | | 2/2001 | Rickerby |
| 6,231,991 | B1 | | 5/2001 | Maloney |
| 6,231,998 | B1 | | 5/2001 | Bowker et al. |
| 6,258,467 | B1 | | 7/2001 | Subramanian |
| 6,284,323 | B1 | | 9/2001 | Maloney |
| 6,319,614 | B1 | | 11/2001 | Beele |
| 6,333,090 | B1 | * | 12/2001 | Schulz et al. |
| 6,365,281 | B1 | | 4/2002 | Subramanian et al. |
| 6,387,526 | B1 | | 5/2002 | Beele |
| 6,387,539 | B1 | | 5/2002 | Subramanian |
| 2004/0043244 | A1 | | 3/2004 | Bruce et al. |

FOREIGN PATENT DOCUMENTS

| | | | |
|---|---|---|---|
| EP | 0816526 | 10/2001 | ..... C23C/4/04 |
| WO | 01/18274 | 3/2001 | |
| WO | 0163008 | 8/2001 | ..... C23C/28/00 |

OTHER PUBLICATIONS

Khor, K.A.; and Yang, J., "Rapidly Solidified Neodymia–Stabilised Zirconia Coatings Prepared by DC Plasma Spraying", Surface and Coatings Technology 96 (1997) 313–322.

Zhu, Dongming; and Miller, Robert A.: Thermal Conductivity and Sintering Behavior of Advanced Thermal Barrier Coatings, NASA/TM—2002–211481, May 2002.

US Publication No. US 2002/0061416 A1, Published May 23, 2002, Ramesh Subramanian.

P.G. Klemens, M. Gell, Thermal Conductivity of Thermal Barrier Coatings, Materials Science and Engineering A245 (1998) 143–149.

D. Chubb, A. Pal, M. Patton, P. Jenkins, Rare Earth Doped High Temperature Ceramic Selective Emitters, NASA, Feb. 1999, 1–28.

H. Wang, R.B. Dinwiddie and P.S. GaaL, "Multiple Station Thermal Diffusivity Instrument", Thermal Conductivity 23, Proceedings of the Twenty–Third International Thermal Conductivity Conference, p119–126, 1996.

* cited by examiner

*Primary Examiner*—Deborah Jones
*Assistant Examiner*—Jennifer McNeil
(74) *Attorney, Agent, or Firm*—Mitchell D. Bittman

(57) ABSTRACT

This invention provides a thermal barrier ceramic coating for application to a metallic article, with the ceramic coating having a formula of $Re_xZr_{1-x}O_y$ wherein Re is a rare earth element selected from the group consisting of Ce, Pr, Nd, Pm, Sm, Eu, Tb, Dy, Ho, Er, Tm, Yb and Lu where O<X<0.5 and 1.75<Y<2. A preferred embodiment is wherein Re is Nd.

43 Claims, 6 Drawing Sheets

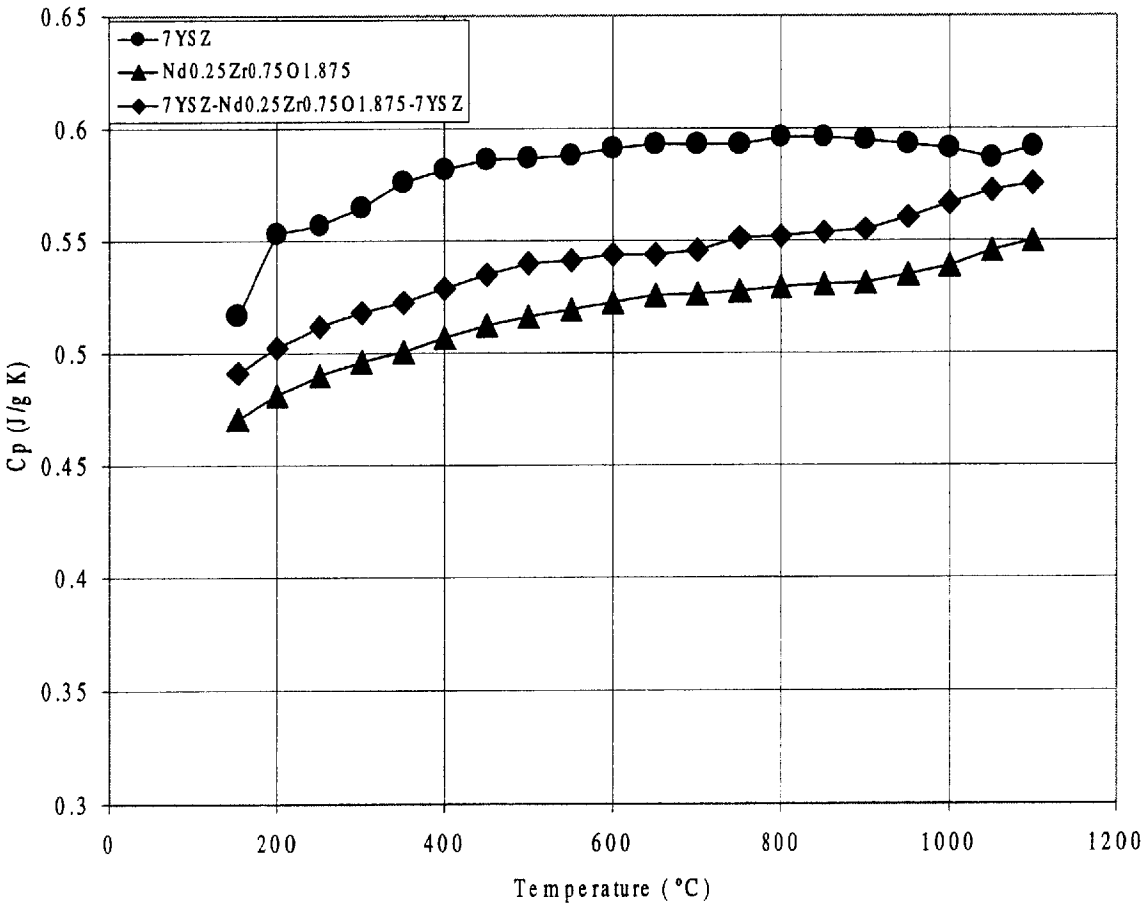
Fig. 4 Specific heat of coatings vs. temperature

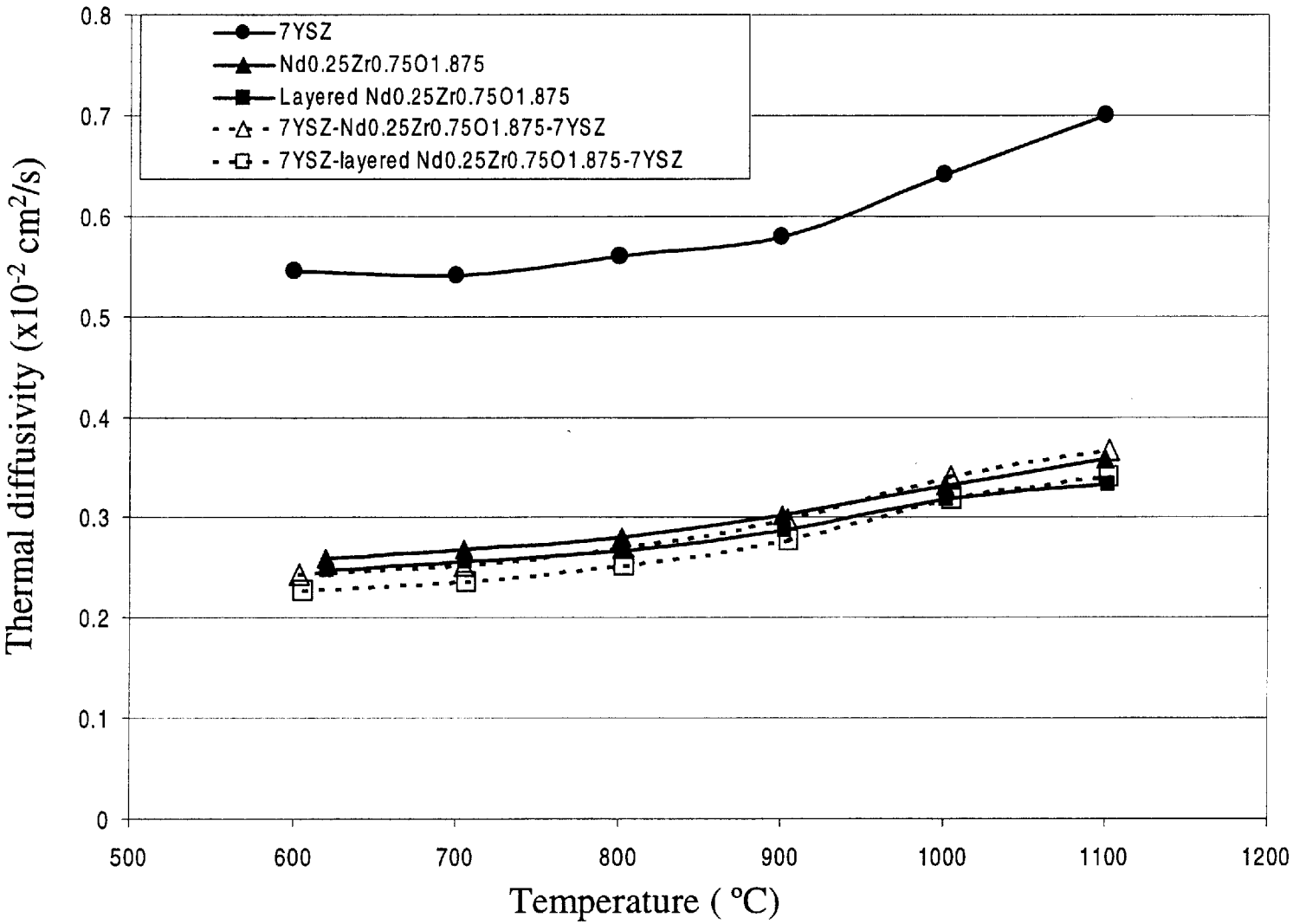
Fig. 5 Thermal diffusivity of coatings vs. temperature

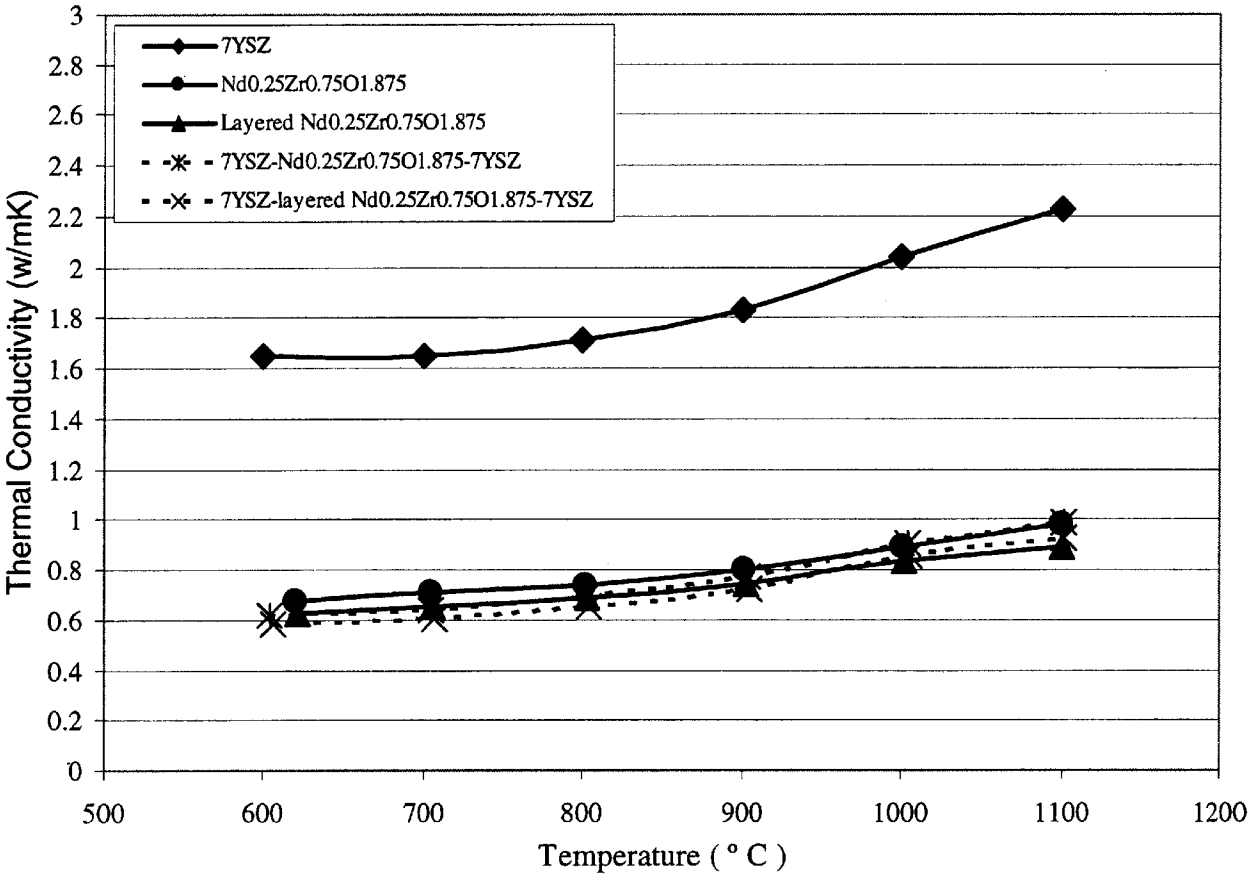
Fig. 6 Thermal conductivity of coatings as deposited vs. temperature

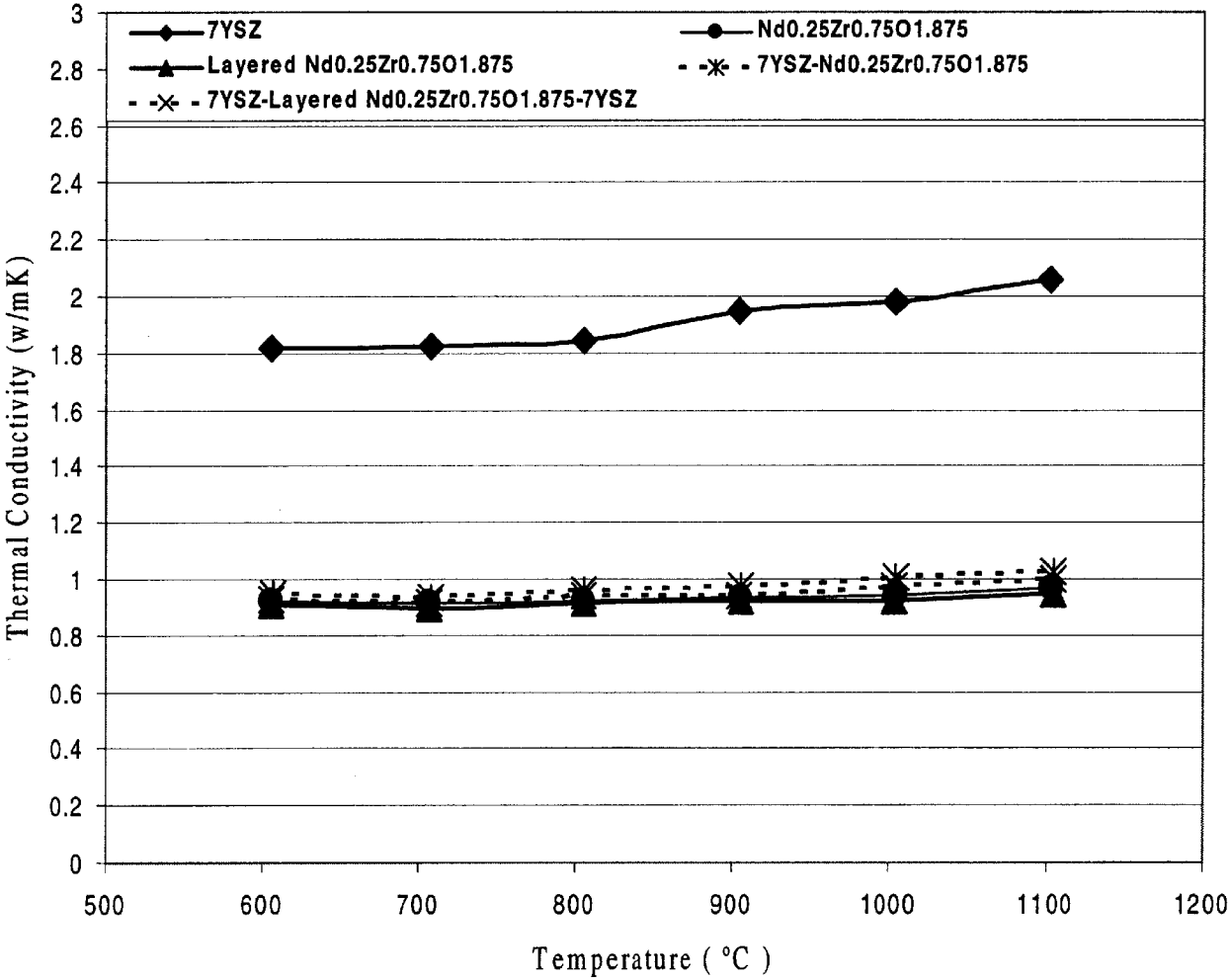
Fig.7 Thermal conductivity of coatings as aged vs. temperature

THERMAL BARRIER COATING HAVING LOW THERMAL CONDUCTIVITY

FIELD OF THE INVENTION

The present invention relates generally to the field of thermal barrier coatings that are used in elevated temperature applications such as gas turbine engines. In particular, this invention relates to a thermal insulating ceramic coating which has a low thermal conductivity and to the metallic articles such as turbine components, (e.g. blades and vanes) that the coatings are applied to prevent the components from overheating during high temperature operation.

BACKGROUND OF THE INVENTION

Advanced gas turbine engines are continuously pursuing higher thrust and efficiency by the use of increased operating temperatures. However, the demand of increasing temperature is limited by the ability of most advanced nickel and cobalt based superalloy turbine blades and vanes to maintain their mechanical strength when exposed to the heat, oxidation, erosion and corrosion environment. Thus it is desirable to increase turbine engine operating temperatures, while decreasing the heat transfer to the metallic parts. One approach is to apply a thermal barrier coating onto the turbine blades and vanes to insulate the components from the high temperature operating environment. The ability of the thermal barrier coating to decrease the temperature to the metallic substrate depends upon the thermal conductivity of the thermal barrier coating. It is therefore desirable to develop thermal barrier coatings having low thermal conductivity to insulate effectively the thermal transfer to the components used in gas turbine engines.

Efforts have been made to lower the thermal conductivity of thermal barrier coatings by modifying the chemistry and microstructure of current 7YSZ thermal barrier coating systems as disclosed in EP0816526A2, U.S. Pat. No. 6,071,628, U.S. Pat. No. 5,846,605, U.S. Pat. No. 6,183,884B1, U.S. Pat. No. 5,792,521, U.S. Pat. No. 5,687,679, W01/63008 and U.S. Pat. No. 6,284,323B1. These approaches decreased thermal conductivity of thermal barrier coatings to various extents with the minimum reported to be about half the thermal conductivity of typical 7 wt % yttria stabilized zirconia (7YSZ).

It is a main object of this invention to decrease thermal conductivity of thermal barrier coatings by providing a new ceramic material with low thermal conductivity and a method of applying such a material onto the metallic articles to form a thermal barrier coating system with increase thermal insulation capability.

SUMMARY OF THE INVENTION

Briefly, this invention provides a thermal barrier ceramic coating for application to a metallic article, with the ceramic coating having a formula of $Re_xZr_{1-x}O_y$ wherein Re is a rare earth element selected from the group consisting of Ce, Pr, Nd, Pm, Sm, Eu, Tb, Dy, Ho, Er, Tm, Yb and Lu where $0<X<0.5$ and $1.75<Y<2$. A preferred embodiment is wherein Re is Nd.

BRIEF DESCRIPTION OF THE DRAWINGS

FIG. 4 shows the specific heat of coatings vs. temperature.

FIG. 5 shows the thermal diffusivity of coatings vs. temperature.

FIG. 6 shows the thermal conductivity of coatings as deposited vs. temperature.

FIG. 7 shows the thermal conductivity of coatings as aged vs. temperature.

DETAILED DESCRIPTION OF THE INVENTION

Figure 1:
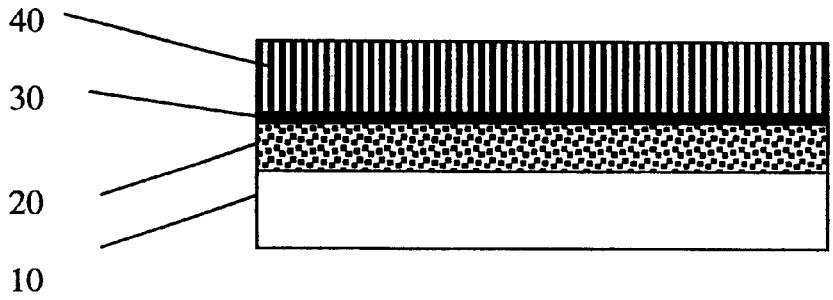
FIG. 1 shows the ceramic coating, $Re_xZr_{1-x}O_y$, which was applied by EBPVD onto a metallic bond coat.

This invention provides a thermal barrier ceramic coating having a formula of $Re_xZr_{1-x}O_y$, where $0<x<0.5$, $1.75<y<2$ and Re is a rare earth element selected from Ce, Pr, Nd, Pm, Sm, Eu, Tb, Dy, Ho, Er, Tm, Yb and Lu. The ceramic is formed by doping oxides of the selected rare earth elements into a host zirconia ceramic. A preferred embodiment is where Re is Nd with the formula $Nd_xZr_{1-x}O_y$, where $0<X<0.5$ and $1.75<Y<2$. The $Nd_xZr_{1-x}O_y$ ceramic coating can be prepared by doping 10 to 15 mole % of $Nd_2O_3$ into $ZrO_2$. One example of $Nd_xZr_{1-x}O_y$ is $Nd_{0.25}Zr_{0.75}O_{1.875}$ having a non-pyrochlore, cubic crystal structure with 14.3 mole % of $Nd_2O_3$ doped into $ZrO_2$. The ceramic coating of this invention is applied to a metallic article providing a thermal barrier coating with low thermal conductivity.

The ceramic coating of this invention has a low thermal conductivity generally within the range of about 0.6 to 1.0 W/mK from 600° C. to 1100° C. The ceramic coating $Nd_{0.25}Zr_{0.75}O_{1.875}$ as deposited was measured to have a thermal conductivity of 0.68–0.98 W/mK from 600° C. to 1100° C. This thermal conductivity is 41 to 44% of the measured thermal conductivity of a typical 7YSZ coating (1.65–2.22 W/mK from 600° C. to 1100° C.). The ceramic coating $Nd_{0.25}Zr_{0.75}O_{1.875}$ as aged (after subjecting the coating to a heat treat of 1200° C. for 50 hours) was measured to have a thermal conductivity of 0.90–1.00 W/mK (from 600° C. to 1100° C.), which is about 46 to 52% of the measured thermal conductivity of a typical 7YSZ coating as aged.

Techniques for applying the ceramic coatings, $Re_xZr_{1-x}O_y$, include air plasma thermal spray (APS), low pressure plasma spray (LPPS), high velocity oxygen fuel (HVOF), sputtering and electron beam physical vapor deposition (EBPVD), etc. In a preferred embodiment the ceramic coating is applied by electron beam physical vapor deposition (EBPVD) due to the columnar microstructure with inter-column gaps produced. The ceramic coating, $Nd_{0.25}Zr_{0.75}O_{1.875}$, can be deposited as a straight columnar microstructure or as a layered microstructure for further reduction in thermal conductivity. Introducing the layered microstructure into the $Nd_{0.25}Zr_{0.75}O_{1.875}$ ceramic coating decreased its thermal conductivity to 0.63–0.89 W/mK from 600° C. to 1100° C., that is 38 to 40% of the thermal conductivity of a typical 7YSZ coating. Generally, the ceramic coating is applied to a thickness within the range of about 5 to 500 $\mu$m, preferably about 25 to 400 $\mu$m. In a layered microstructure, the ceramic coating can have at least 2 layers, preferably from 5 to 100 layers, each at least about 1 $\mu$m thick, preferably about 5 to 25 $\mu$m thick.

To provide a strong bonding between the ceramic coating and the metallic article or metallic bond coat, a ceramic bond coat, such as a 6–8 wt % YSZ can be coated prior to applying the ceramic coating. To provide increased erosion resistance to the ceramic coating a protective ceramic top coat, such as a 6–8 wt % YSZ, can be applied to the top of the ceramic coating. In a preferred embodiment the ceramic coating can be "sandwiched" between the ceramic bond coat on the bottom and the protective ceramic top coat on the top. Coating 7YSZ with an appropriate thickness for adhesion and erosion resistance at the bottom and top of the $Nd_{0.25}Zr_{0.75}O_{1.875}$ ceramic coating provides a thermal conductivity which is equivalent to the ceramic coating without the ceramic bond coat and/or protective ceramic top coat.

The process of applying the ceramic coating by EBPVD is similar to that of applying 7YSZ in production. The evaporating source in a crucible is the $Re_xZr_{1-x}O_y$ solid ingot, which is sintered zirconia doped with the selected rare earth oxide. The layered microstructure of the ceramic coating, $Re_xZr_{1-x}O_y$, was applied by evaporating the solid ingots from two crucibles under controlled gun on/off program of electron beam physical vapor deposition. The ceramic coating, $Re_xZr_{1-x}O_y$, with 6–8 wt % YSZ at the bottom and/or top was deposited by evaporating the $Re_xZr_{1-x}O_y$ solid ingot from one crucible and 6–8 wt % YSZ ingot from another crucible by electron beam physical vapor deposition.

For increased adhesion a metallic bond coat is applied onto the metallic article, such as a nickel or cobalt based superalloys prior to the ceramic coating, $Re_xZr_{1-x}O_y$, deposition. The metallic bond coat can be an MCrAlY alloy, wherein M is Ni, Co or mixtures thereof. Such alloys have a broad composition of 10 to 35% chromium, 5 to 15% aluminum, 0.01 to 1% yttrium, or hafnium, or lanthanum, with M being the balance. Minor amounts of other elements such as Ta or Si may also be present. The MCrAlY bond coat can be applied by EBPVD, though sputtering, low pressure plasma or high velocity oxy fuel spraying or entrapment plating may also be used.

Alternatively, the metallic bond coat can be comprised of an intermetallic aluminide such as nickel aluminide or platinum aluminide. The aluminide bond coating can be applied by standard commercially available aluminide processes whereby aluminum is reacted at the substrate surface to form an aluminum intermetallic compound which provides a reservoir for the growth of an alumina scale oxidation resistant layer. Thus the aluminide coating is predominately composed of aluminum intermetallic [e.g., NiAl, CoAl and (Ni, Co) Al phase] formed by reacting aluminum vapor species, aluminum rich alloy powder or surface layer with the substrate elements in the outer layer of the superalloy component. This layer is typically well bonded to the substrate. Aluminizing may be accomplished by one of several conventional prior art techniques, such as, the pack cementation process, spraying, chemical vapor deposition, electrophoresis, sputtering, and appropriate diffusion heat treatments. Other beneficial elements can also be incorporated into diffusion aluminide coatings by a variety of processes. Beneficial elements include Pt, Pd, Si, Hf, Y and oxide particles, such as alumina, yttria, hafnia, for enhancement of alumina scale adhesion, Cr and Mn for hot corrosion resistance, Rh, Ta and Cb for diffusional stability and/or oxidation resistance and Ni, Co for increasing ductility or incipient melting limits. In the specific case of platinum modified diffusion aluminide coating layers, the coating phases adjacent to the alumina scale will be platinum aluminide and/or nickel-platinum aluminide phases (on a Ni-base superalloy).

Through oxidation an alumina (i.e., aluminum oxide) layer is formed over the metallic bond coat. This alumina layer provides both oxidation resistance and a bonding surface for a ceramic coating. The alumina layer may be formed before the ceramic coating is applied, during application of the coating or subsequently by heating the coated article in an oxygen containing atmosphere at a temperature consistent with the temperature capability of the superalloy, or by exposure to the turbine environment. The sub-micron thick alumina scale will thicken on the aluminide surface by heating the material to normal turbine exposure conditions. The thickness of the alumina scale is preferably sub-micron (up to about one micron). The alumina layer may also be deposited by chemical vapor deposition or by EBPVD following deposition of the metallic bond coat.

Alternatively, the metallic bond coat may be eliminated if the substrate is capable of forming a highly adherent alumina scale or layer. Examples of such substrates are very low sulfur (<1 ppm) single crystal superalloys, such as PWA 1487 and Rene N5, which also contain 0.1% yttrium to enhance adhesion of the thermally grown alumina scale.

FIG. 1 shows the ceramic coating, $Re_xZr_{1-x}O_y$, 40 which was applied by EBPVD onto a metallic bond coat 20, such as an MCrAlY and/or platinum modified aluminide. The bond coat 20 was applied to the metallic article 10, of nickel or cobalt based superalloys prior to the application of the ceramic coating 40. The bond coat 20 provides strong adhesion between the metallic substrate 10 and the ceramic coating 40. The ceramic coating adheres to the bond coat 20 through a thermally grown alumina film 30 on the bond coat 20.

Figure 2:
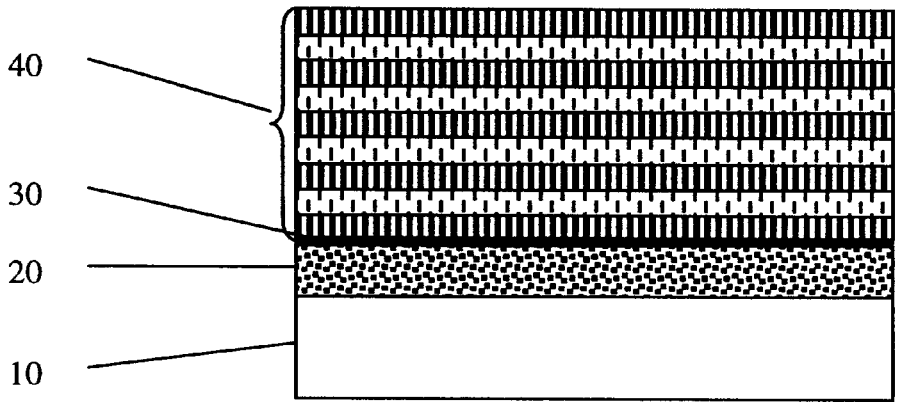
FIG. 2 shows the ceramic coating, $Re_xZr_{1-x}O_y$, applied in a layered microstructure.

FIG. 2 shows the ceramic coating, $Re_xZr_{1-x}O_y$, 40 applied in a layered microstructure. The interface boundaries between the layers are another potential source of phonon scattering and thermal conductivity reduction.

Figure 3:
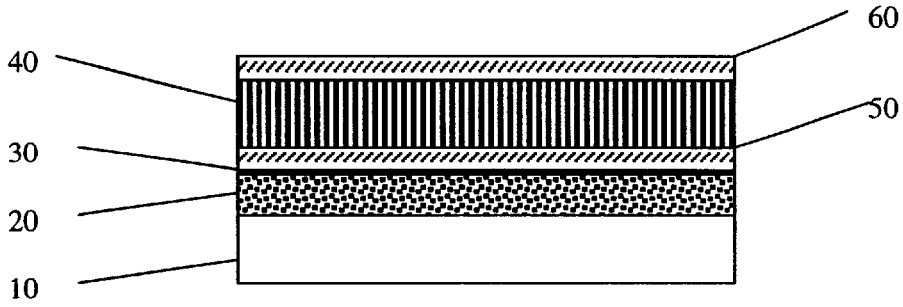
FIGS. 3(*a*) and 3(*b*) show 6–8 wt % YSZ coatings which are coated before and after the ceramic coating, $Re_xZr_{1-x}O_y$.
Figure 3:
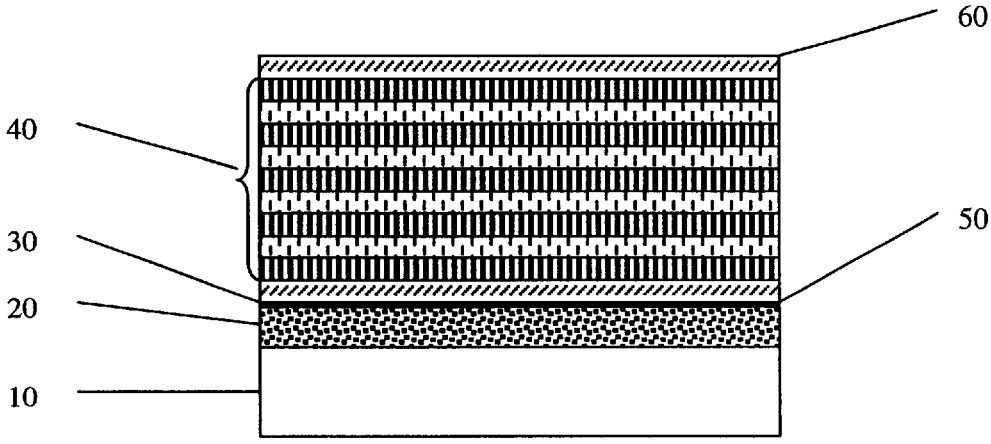

FIGS. 3(*a*) and 3(*b*) shows 6–8 wt % YSZ coatings, 50 and 60, which are coated before and after the ceramic coating, $Re_xZr_{1-x}O_y$, 40 to form a "sandwich" structure with the ceramic coating 40 in the middle, providing strong bonding between the ceramic coating 40 and bond coat 20 and to provide increased erosion resistance on the top surface which is subject to hot gas impact during turbine engine operation. The ceramic bond coat, 6–8 wt % YSZ, 50 for good bonding, generally has a thickness of about 2 to 25 $\mu$m, preferably about 5 to 15 $\mu$m. The protective ceramic top coat, 6–8 wt % YSZ, 60 for erosion resistance, generally has a thickness of about 5 to 50 $\mu$m preferably about 5 to 25 $\mu$m thick.

The ceramic coating system of this invention provides many advantages for use in gas turbine engines. The reduction in thermal conductivity of 50 to 60 percent can reduce the thickness required for the thermal barrier coating (TBC) by approximately one half for the same degree of thermal insulation. This will lower the cost of the TBC due to the time saved in applying the coating, ingot material savings and energy savings in production. Decreasing in the coating thickness will also lower the weight of the gas turbine component, e.g. blades and vanes, which can provide a significant reduction in the weight of the disk that holds these components. Depositing the same thickness of the ceramic coating will allow an increased operating temperature to be achieved without overheating the metallic parts allowing the engine to operate a higher thrust and efficiency. The increased insulating capabilities of the ceramic coating could also reduce the requirements for air cooling the part.

This invention is generally applicable to any metallic article which uses thermal barrier coating system, and includes various modifications according to the principles of this invention.

EXAMPLE

A ceramic coating having a formula $Nd_{0.25}Zr_{0.75}O_{1.875}$ was applied by EBPVD evaporating a $ZrO_2$ ceramic ingots doped with 14.3 mole % of $Nd_2O_3$. The coating displayed a columnar structure oriented perpendicularly to the surface of the substrate. The intercolumnar gaps are visible and tend to be gradually wider from bottom to top. Phase identification conducted on as-deposited ceramic coating of $Nd_{0.25}Zr_{0.75}O_{1.875}$ by XRD showed a ceramic coating of $Nd_{0.25}Zr_{0.75}O_{1.875}$ having a non-pyrochlore, cubic crystal structure produced on the top layer of the EBPVD thermal barrier coating system.

It is known that the thermal conductivity of material K (W/mK) is determined by its thermal diffusivity $\alpha$ ($cm^2/s$), density $\rho$ ($g/cm^3$) and specific heat $C_p$(J/g K), i.e. $K=\alpha\cdot\rho\cdot C_p$. The specific heat of the ceramic coating $Nd_{0.25}Zr_{0.75}O_{1.875}$ was tested using Differential Scanning Calorimetry (DSC) on an Omnitherm DSC 1500 in Oak Ridge National Lab. The samples are free standing ceramic coating, i.e. an intact ceramic coating without substrate. The free standing samples of ceramic coating are 180 to 230 $\mu$m thick and are machined to 6 mm in diameter to meet the requirements of the testing instrument. The test was run in the temperature range of 100° C. to 1100° C. using sapphire as the baseline standard. The results in FIG. 4 show that the specific heat of $Nd_{0.25}Zr_{0.75}O_{1.875}$ ceramic coating is about 12%–14% lower than that of typical 7YSZ. The ceramic coating of $Nd_{0.25}Zr_{0.75}O_{1.875}$ with 7YSZ coating at the bottom and top shows 4%–5% higher specific heat than $Nd_{0.25}Zr_{0.75}O_{1.875}$ and 8%–10% lower than 7YSZ coating.

The thermal diffusivity ($\alpha$) was measured by the laser flash technique at Oak Ridge National Laboratory on a Flashline 5000 Thermal Diffusivity System, see H. Wang, R. B. Dinwiddie and P. S. GAAL, "Multiple Station Thermal Diffusivity Instrument", THERMAL CONDUCTIVITY 23, Proceedings of the Twenty-Third International Thermal Conductivity Conference, P119–126. Two or three free standing ceramic samples of each kind were measured at every 100-degree interval from 600° C. to 1100° C. Three measurements of each sample were conducted at every temperature. The time-temperature curves were analyzed by the method of Clark and Taylor, which takes into account radiation losses and uses the heating part of the curve to calculate thermal diffusivity. The average readings of two or three samples with three measurements in each at temperature from 600° C. to 1000° C. are plotted in FIG. 5. It shows the thermal diffusivity of $Nd_{0.25}Zr_{0.75}O_{1.875}$ is 48%–53% lower than that of typical 7YSZ coating. A layered microstructure further decreases the thermal diffusivity of $Nd_{0.25}Zr_{0.75}O_{1.875}$. Applying a thin layer of 7YSZ at the bottom and the top of $Nd_{0.25}Zr_{0.75}O_{1.875}$ did not significantly change the thermal diffusivity of $Nd_{0.25}Zr_{0.75}O_{1.875}$.

The density of the ceramic coating, $Nd_{0.25}Zr_{0.75}O_{1.875}$, is about 5.1 $g/cm^3$, which is similar to that of the typical 7YSZ coating (5.0 $g/cm^3$). This similar density allows the gas turbine component coated with the ceramic coating to have a similar coating weight to that currently used for typical 7YSZ coated components.

The thermal conductivity of the series of $Nd_{0.25}Zr_{0.75}O_{1.875}$ ceramic coatings is calculated according to their value of thermal diffusivity, density and specific heat, and then is plotted in FIG. 6, which shows the thermal conductivity of $Nd_{0.25}Zr_{0.75}O_{1.875}$ ceramic coating as deposited at a temperature 600° C. to 1100° C. The ceramic coating $Nd_{0.25}Zr_{0.75}O_{1.875}$ as deposited shows a superior low thermal conductivity of 0.68–0.98 W/mK, which is 41 to 44% of the measured thermal conductivity of typical 7YSZ coating (1.65–2.22 W/mK from 600° C. to 1100° C). Introducing the layered microstructure into $Nd_{0.25}Zr_{0.75}O_{1.875}$ ceramic coating decreased its thermal conductivity to 0.63–0.89 W/mK from 600° C. to 1100° C. that is 38 to 40% of the typical 7YSZ coating. Providing a 7YSZ coating at the bottom and top of both the $Nd_{0.25}Zr_{0.75}O_{1.875}$ ceramic coating and a layered $Nd_{0.25}Zr_{0.75}O_{1.875}$ ceramic coating provided an equivalent low thermal conductivity level. The thermal insulation capability of the ceramic coating is primarily attributed to its crystal structure and chemistry. Heat conduction is a motion of carriers of thermal energy. In dielectric ceramic materials, the carriers are lattice vibration, i.e. phonon motion. The high intrinsic point defects of substitutional atoms Nd and oxygen vacancy leads to the reduction in the mean free path length of a phonon. The large difference in atomic mass and ionic radius between Nd (144.2 g in atomic mass, 1.05 Å in ionic radius) and Zr (91.2 g in atomic mass, 0.79 Å in ionic radius) in the compound, results in a high reduction in thermal conductivity.

Another significant concern is the thermal conductivity of a thermal barrier coating during operation in a turbine gas engine where the coatings are subject to high temperature for a long period of time. There are two factors that will affect the intrinsic thermal conductivity during engine operation—sintering and radiation. To investigate the effect of sintering on thermal conductivity of the ceramic coatings, samples of the $Nd_{0.25}Zr_{0.75}O_{1.875}$ ceramic coatings applied by EBPVD were aged heat treat at 1200° C. for 50 hours. FIG. 7 shows the thermal conductivity of $Nd_{0.25}Zr_{0.75}O_{1.875}$ ceramic coatings and typical 7YSZ coating after aging heat treat. Comparing the thermal conductivity of the coatings as deposited in FIG. 6, all the coatings as aged have higher thermal conductivity than those as deposited. This is because that the gaps between the adjacent columns in EBPVD applied thermal barrier coatings will be narrowed or even be closed by sintering at high temperature. The lack of scattering sites of vertical pores will increase thermal conductivity of the coating. However, it is noticeable that the thermal conductivity of the $Nd_{0.25}Zr_{0.75}O_{1.875}$ ceramic coatings as aged is still quite low at 0.90–1.00 W/mK after sintering, which is about 46 to 52% of the thermal conductivity of 7YSZ coating as aged.

During engine operation at high temperature, a thermal barrier coating is subjected to incident radiation from the hot combustor. Radiation is then absorbed by the soot that is usually covered on the exposed coating due to the combustion environment. A translucent coating, such as typical yttria stabilized zirconia, permits the energy to be transported internally by radiation, thereby increasing the total energy transfer and acting to increase thermal conductivity. However, the $Nd_{0.25}Zr_{0.75}O_{1.875}$ ceramic coating has the color of gray-blue, which can reduce the internal radiation transport. Therefore, the effect of radiation on the insulating ability of the new coatings is expected to be negligible.

What is claimed is:

1. A metallic article comprising a metallic substrate and a thermal barrier ceramic coating on its surface with the ceramic coating having a formula of $Re_xZr_{1-x}O_y$ where Re is a rare earth element selected from the group consisting of Ce, Pr, Nd, Pm, Sm, Eu, Tb, Dy, Ho, Er, Tm, Yb and Lu and where $0<X<0.5$ and $1.75<y<2$.

2. Article of claim 1 further comprising a metallic bond coat between the ceramic coating and the metallic substrate.

3. Article of claim 2 wherein the metallic bond coat is an MCrAlY, wherein M is selected from Ni and/or Co.

4. Article of claim 2 wherein the metallic bond coat is intermetallic aluminide.

5. Article of claim 2 further comprising a ceramic bond coat between the metallic bond coat and the ceramic coating.

6. Article of claim 5 further comprising a protective ceramic top coat overlaying the ceramic coating.

7. Article of claim 2 wherein the metallic article is a turbine component.

8. Article of claim 7 wherein the turbine component has a metallic substrate of a nickel or cobalt based superalloy.

9. Article of claim 1 wherein the ceramic coating has a columnar microstructure.

10. Article of claim 1 wherein the ceramic coating has a layered microstructure.

11. Article of claim 1 further comprising a ceramic bond coat between the ceramic coating and the metallic substrate.

12. Article of claim 11 wherein the ceramic bond coat is a 6 to 8 wt % YSZ.

13. Article of claim 12 wherein the ceramic bond coat has a thickness of about 2 to 25 $\mu$m.

14. Article of claim 1 further comprising a protective ceramic top coat overlaying the ceramic coating.

15. Article of claim 14 wherein the protective ceramic coating is 6 to 8 wt % YSZ.

16. Article of claim 15 wherein the protective ceramic top coat has a thickness of about 5 to 50 $\mu$m.

17. Article of claim 1 wherein the ceramic coating has a thermal conductivity of from about 0.6 to 1.0 W/mK from 600° C. to 1100° C.

18. Article of claim 1 wherein the ceramic coating has been applied by EBPVD, air plasma spray or HVOF.

19. Article of claim 1 wherein the ceramic coating has a thickness within the range of about 5 to 500 $\mu$m.

20. A metallic article comprising a metallic substrate and a thermal barrier ceramic coating on its surface, the ceramic coating having a formula of $Nd_xZr_{1-x}O_y$ wherein $0<X<0.5$ and $1.75<Y<2$.

21. Article of claim 20 wherein the formula is $Nd_{0.25}Zr_{0.75}O_{1.875}$ with the ceramic having a cubic crystal structure.

22. Article of claim 21 wherein the ceramic coating has a density of about 5.1 g/cm$^3$.

23. Article of claim 20 further comprising a metallic bond coat between the ceramic coating and the metallic substrate.

24. Article of claim 23 wherein the metallic bond coat is an MCrAlY, wherein M is selected from Ni and/or Co.

25. Article of claim 23 wherein the metallic bond coat is intermetallic aluminide.

26. Article of claim 23 further comprising a ceramic bond coat between the metallic bond coat and the ceramic coating.

27. Article of claim 26 further comprising a protective ceramic top coat overlaying the ceramic coating.

28. Article of claim 27 wherein the protective ceramic coating is 6–8 wt % YSZ having a thickness of about 5 to 50 $\mu$m.

29. Article of claim 26 wherein the ceramic bond coat is a 6–8 wt % YSZ having a thickness of about 2 to 25 $\mu$m.

30. Article of claim 20 wherein the ceramic coating has a columnar microstructure.

31. Article of claim 20 wherein the ceramic coating has a layered microstructure.

32. Article of claim 20 further comprising a ceramic bond coat between the ceramic coating and the metallic substrate.

33. Article of claim 20 further comprising a protective ceramic top coat overlaying the ceramic coating.

34. Article of claim 20 wherein the ceramic coating has a thermal conductivity of from about 0.6 to 1.0 W/mK from 600° C. to 1100° C.

35. Article of claim 20 wherein the ceramic coating has been applied by EBPVD, air plasma spray or HVOF.

36. Article of claim 20 wherein the metallic article is a turbine component.

37. Article of claim 36 wherein the turbine component has a metallic substrate of a nickel or cobalt based superalloy.

38. A method for applying a thermal barrier ceramic coating to a metallic article comprising:

forming a ceramic having a formula $Re_xZr_{1-x}O_y$ where Re is a rare earth element selected from the group consisting of Ce, Pr, Nd, Pm, Sm, Eu, Tb, Dy, Ho, Er, Tm, Yb and Lu and wherein $O<X<0.5$ and $1.75<Y<2$ by doping oxides of Re into a zirconia oxide ceramic; and applying the ceramic as a coating onto the metallic article.

39. Method of claim 38 wherein the ceramic is applied by electron beam physical vapor deposition.

40. Method for applying a thermal barrier ceramic coating to a metallic article comprising:

forming a ceramic having a formula $Nd_xZr_{1-x}O_y$, wherein $O<X<0.5$ and $1.75<Y<2$ by doping Nd oxide into a Zr oxide ceramic; and applying the ceramic as a coating onto the metallic article.

41. Method of claim 40 wherein 10 to 15 mole % of $Nd_2O_3$ is doped into $ZrO_2$.

42. Method of claim 41 wherein the ceramic is applied by electron beam physical vapor deposition.

43. Method of claim 42 wherein 14.3 mole % of $Nd_2O_3$ is doped into $ZrO_2$ forming $Nd_{0.25}Zr_{0.75}O_{1.875}$.

* * * * *